US005848369A

United States Patent [19]

Kobelt

[11] Patent Number: 5,848,369

[45] Date of Patent: Dec. 8, 1998

[54] RESILIENT COMPENSATOR AND MANUAL OVERRIDE APPARATUS AND METHOD FOR ELECTRONIC CONTROL SYSTEM

[76] Inventor: Jacob Kobelt, 1654 Ocean Park Road, Surrey, British Columbia, Canada, V4A 4V5

[21] Appl. No.: 601,159

[22] Filed: Feb. 13, 1996

[51] Int. Cl.[6] ..... G06F 17/00; G06F 19/00; G06F 7/00

[52] U.S. Cl. ..... 701/54; 701/67; 701/50

[58] Field of Search ..... 701/99, 100, 101, 701/102, 1, 51, 50, 54, 67; 477/79, 83, 111, 112, 122; 364/474.31; 475/345, 347

[56] References Cited

U.S. PATENT DOCUMENTS

| | | | |
|---|---|---|---|
| 4,789,939 | 12/1988 | Hamburg | 701/103 |
| 5,053,960 | 10/1991 | Brekkestran et al. | 701/51 |
| 5,065,326 | 11/1991 | Sahm | 701/50 |
| 5,557,526 | 9/1996 | Anderson | 701/50 |

*Primary Examiner*—William A. Cuchlinski, Jr.
*Assistant Examiner*—Gertrude Arthur

[57] ABSTRACT

A control apparatus for controlling an item comprises an input controller which outputs a signal to a resilient buffer apparatus comprising an input member, an output member and a resilient member. The input member moves in response to the input signal from the input controller, and the output member is at least partially responsive to movement of the input member and cooperates with the item to be controlled. The resilient member cooperates with the input and output members to provide a resilient buffer between initial movement of the input member and corresponding movement of the output member. A feedback apparatus cooperates with the input member and input controller and generates a feedback signal to the input controller to accurately locate the input member. The resilient member is pre-loaded and generates a resilient force against relative movement between the members in a first direction and an opposite second direction. The input and output members can be mounted for rotation about a common main axis, or for longitudinal axial movement. A manual override apparatus permits disengagement from the resilient buffer for emergency use, and to facilitate maintenance, and can be automatically and remotely re-engaged.

22 Claims, 4 Drawing Sheets

RESILIENT COMPENSATOR AND MANUAL OVERRIDE APPARATUS AND METHOD FOR ELECTRONIC CONTROL SYSTEM

BACKGROUND OF THE INVENTION

The invention relates to a an apparatus for use with electronic controls, particularly a device which facilitates initial set-up and subsequent maintenance of an electronic control system which is required to accurately locate an item to be controlled.

It is known to provide an electronic control system, particularly for a marine vessel, in which one or more manual control stations can generate signals which are fed into a main or on-board micro-processor or controller which generates output signals which are fed to one or more throttle and clutch/gear box controls. Often, additional components can be controlled by the on-board controller, such as syncronisers, controllable pitch propellers, etc.

When such an electronic control system is initially installed in a vessel, a technician uses a laptop computer or portable micro-processor to set up the on-board micro-processor so that signals from the manual control station or stations are correctly processed to attain full, accurate range of signals. For example, a demand signal for full throttle from the manual control should result in full displacement of the fuel rack of a diesel engine or full displacement of the speed adjuster of a governor. This initial set-up of the manual controls and on-board processor can be quite time consuming, and even a small amount of wear in the mechanical linkages can often cause problems shortly after installation, such as failure of the item being controlled to attain the desired final setting e.g. idle and full throttle settings in the engine control. This failure often results in over-working of an automatic feedback system, which in turn can result in one or more feedback power transducers becoming overheated and burning out or cutting out.

For example, lost motion or wear in mechanical linkages can result in a manual input signal for full throttle deteriorating over time to an input at the fuel rack or governor being slightly less than full throttle. A feedback signal transducer on the item being controlled, i.e. the fuel rack or governor, sends a feedback signal to the controller indicating less than full throttle. The controller then attempts to correct the "under-throttle" problem by outputting an error signal to the power transducer which tries again to attain full throttle, but never can attain this due to the lost motion. The power transducer is called to operate for a long time and can become overheated which can result in damage and/or system shut down. To regain the ability for the system to achieve full throttle, a technician must re-set the microprocessor, which again requires the laptop computer or other portable microprocessor and the skill of the technician to re-set it. This is often inconvenient in marine vessels where such equipment and skilled manpower is not always easily available, resulting in reduced efficiency of operation, or eventual failure of the control system.

In addition, it is not unusual for a foreign object to inadvertently obstruct movement of the control linkage and prevent the controlled item from attaining a desired position as demanded by the manual input signal. In such a case, the feedback power transducer again attempts to attain the final position demanded by the manual control, but the foreign object prevents attainment of the desired position, which again can result in overheating and possible damage to the system.

The problems described above are found in all automatic feedback systems known to the inventor, and result from the conventional practice of connecting the feedback signal transducer to the item to be controlled. In the conventional feedback loop, an error signal is generated by a comparator until the item to be controlled attains the desired position, at which time the error signal is zero. Clearly, in the two main situations described above, due to lost motion in the control linkage or an obstruction preventing full movement of the device, the error signal never attains zero, which results in a constant operation of the power transducer, eventually resulting in overload or system failure.

SUMMARY OF THE INVENTION

The invention reduces the difficulties and disadvantages of the prior art by providing a resilient buffer within the control linkage to accommodate wear in the control linkage, or to accommodate an obstruction that might prevent full attainment of the demand signal. The resilient buffer simplifies initial setup of the control system by enabling the technician to deliberately provide a relatively small amount of resilient "over-stroke" in a portion of the system during initial setup to ensure accurate attainment of a setting with an indent or stop, e.g. idle and full throttle and forward and reverse gear positions. The deliberate over-stroke can accommodate anticipated or normal future wear by increasing travel of a control link by a small amount, thus reducing the frequency with which the system must be re-setup to accommodate normal wear. The resilient buffer in the linkage also provides at least partial accommodation to foreign objects that might inadvertently obstruct full movement of the item to be controlled. Thus, the present invention reduces the two problems discussed which can result in overloading of feedback power transducers. In addition, the invention provides a simple mechanical override apparatus to enable local operation of the power and transmission in the engine room, in which normal remote control can be re-attained without direct manual intervention in the engine room.

A control apparatus according to the invention is for controlling an item and comprises an input controller, an input member, an output member, a resilient member and a feedback apparatus. The input controller has an input and an output, the input being adapted to receive a demand signal which is outputted at the output thereof. The input member is adapted to move in response to an input signal outputted from the input controller. The output member is at least partially responsive to movement of the input member and cooperates with the item to be controlled. The resilient member interconnects the input member and the output member to provide a resilient buffer between application of the input signal to the input member and corresponding movement of the output member. The feedback apparatus generates a feedback signal to be fed to the input controller, and cooperates with the input member and the input controller to accurately locate the input member.

Preferably, the resilient member is pre-loaded to generate a force on the output member which is sufficient to control the said item but is less than force applied by the input member, so as to reduce chances of damaging the apparatus. The resilient member cooperates with the input and output members of the resilient buffer to generate a resilient force against relative movement between the members in a first direction, and also in an opposite second direction.

In one embodiment, the input and output members are mounted for rotation about a common main axis, whereas in an alternative the members are mounted for longitudinal axial movement.

A method according to the invention is for controlling an item and comprises the steps of:

outputting from an input controller an electrical signal generated from a demand signal received by the input controller, transducing and transmitting the signal outputted by the controller as a physical movement to an input member, applying the physical movement to a resilient member, and transferring through the resilient member at least a portion of the physical movement to an output member, the output member cooperating with the item to be controlled, and generating a feedback signal reflecting movement of the input member, and transmitting the feedback signal to the input controller to accurately locate the input member.

The method is further characterised by pre-loading the resilient member to augment resistance to movement thereof so that the resilient member generates a force on the output member which is sufficient to control the said item but is less than force applied to the input means to avoid damage to the output means. The method is further characterised by generating a resilient force between the input and output members against relative movement between the members in a first direction, and also in an opposite second direction.

A detailed disclosure following, related to drawings, describes a preferred embodiment of the apparatus and method according to the invention, plus alternatives. However, the invention is capable of expression in structure and method other than those particularly described and illustrated.

DETAILED DESCRIPTION

FIG. 1

Figure 1:
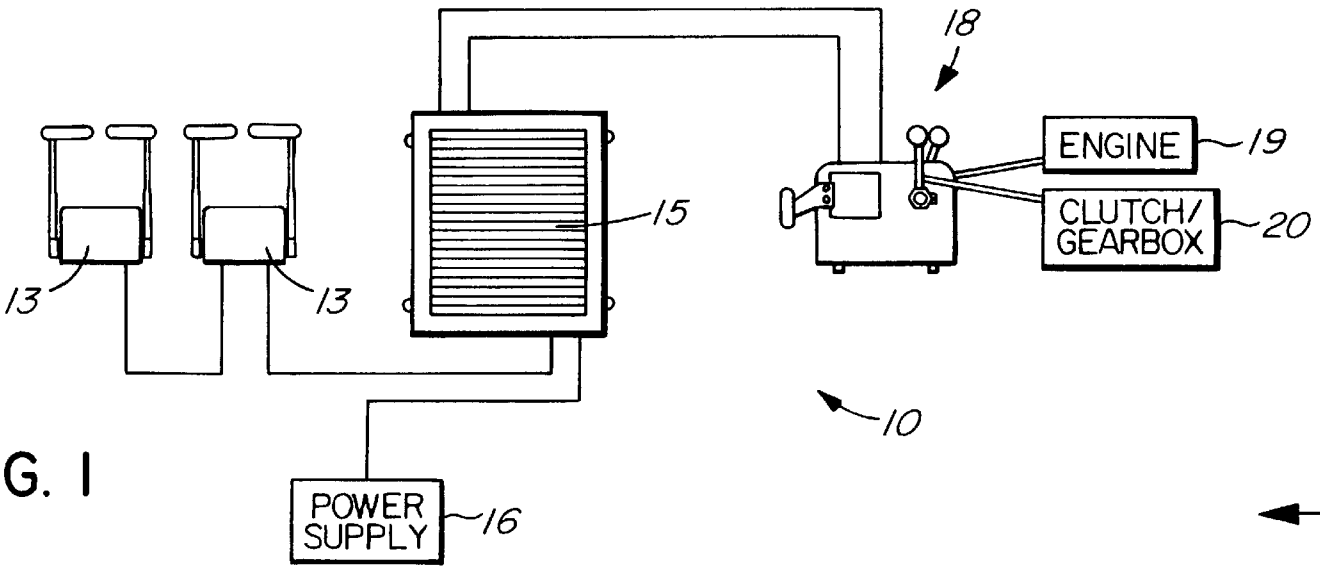
FIG. 1 is a simplified electronic schematic showing a marine electronic control system provided with two manual control heads or controllers, an electronic processor, and a "buffered" actuator according to the invention with outputs connected to an engine and clutch/gear box.

A marine electronic control system according to the invention 10 has two essentially identical manual control heads or controllers 13 which are located at different stations on a marine vessel to enable control of the vessel from the different stations. These heads 13 are connected electrically to a microprocessor or electronic input controller or processor 15 which receives power from a power supply 16 to power logic and motors as is commonly required. The electronic processor 15 is connected to a mechanically buffered actuator apparatus 18 according to the invention, which in turn controls an engine and clutch/gearbox 19 and 20 respectively. The apparatus 18 would normally be located in the engine room, closely adjacent the engine 19 and the clutch/gear box 20 so as to provide local control over the vessel propulsion system by the engine room operator following conventional practise. As will be described, the apparatus 18 also has a manual override for servicing or emergency, which also provides a visual indication of demand signals from the operator.The system 10 responds to a manual demand signal applied by an operator at one or more of the manual control heads 13, the demand signal being processed by the processor 15, which results in a demand signal being fed to the actuator apparatus 18, which in turn outputs appropriate signals to the engine 19 and/or clutch/gear box 20. Thus, the processor 15 serves as an input controller and has an input to receive demands or electrical signals derived from the operator controlling the heads 13. The input controller has an electrical output which is fed to the actuator apparatus 18 as will be described.

Figure 2:
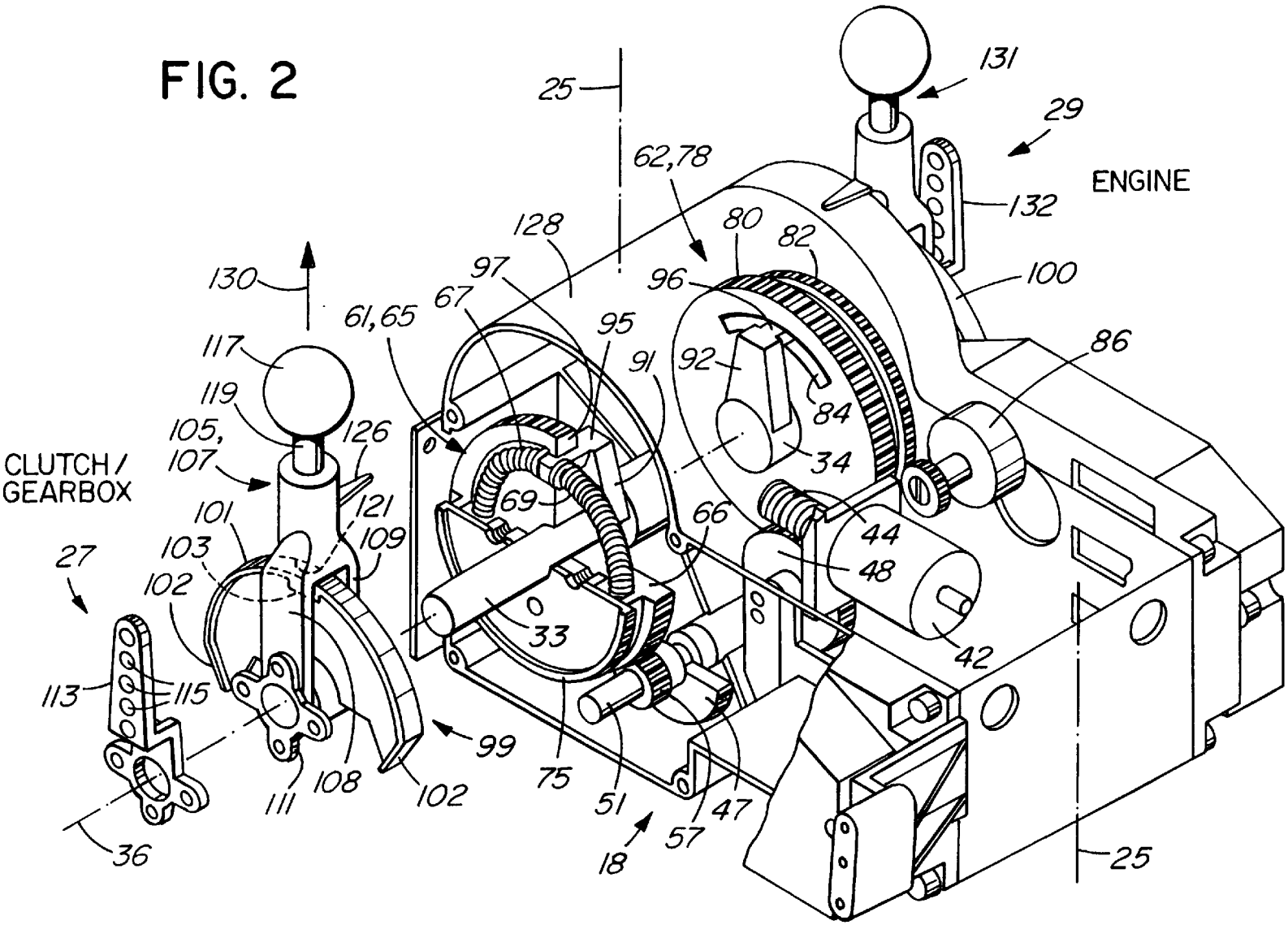
FIG. 2 is a simplified fragmented and partially exploded perspective of a "buffered" rotary actuator according to the invention adapted for controlling a throttle and a clutch/gear box of a marine vessel, the apparatus being shown fitted with a rotary resilient buffer according to the invention, and also having manual override apparatus for emergency use, some portions being omitted for clarity.
Figure 3:
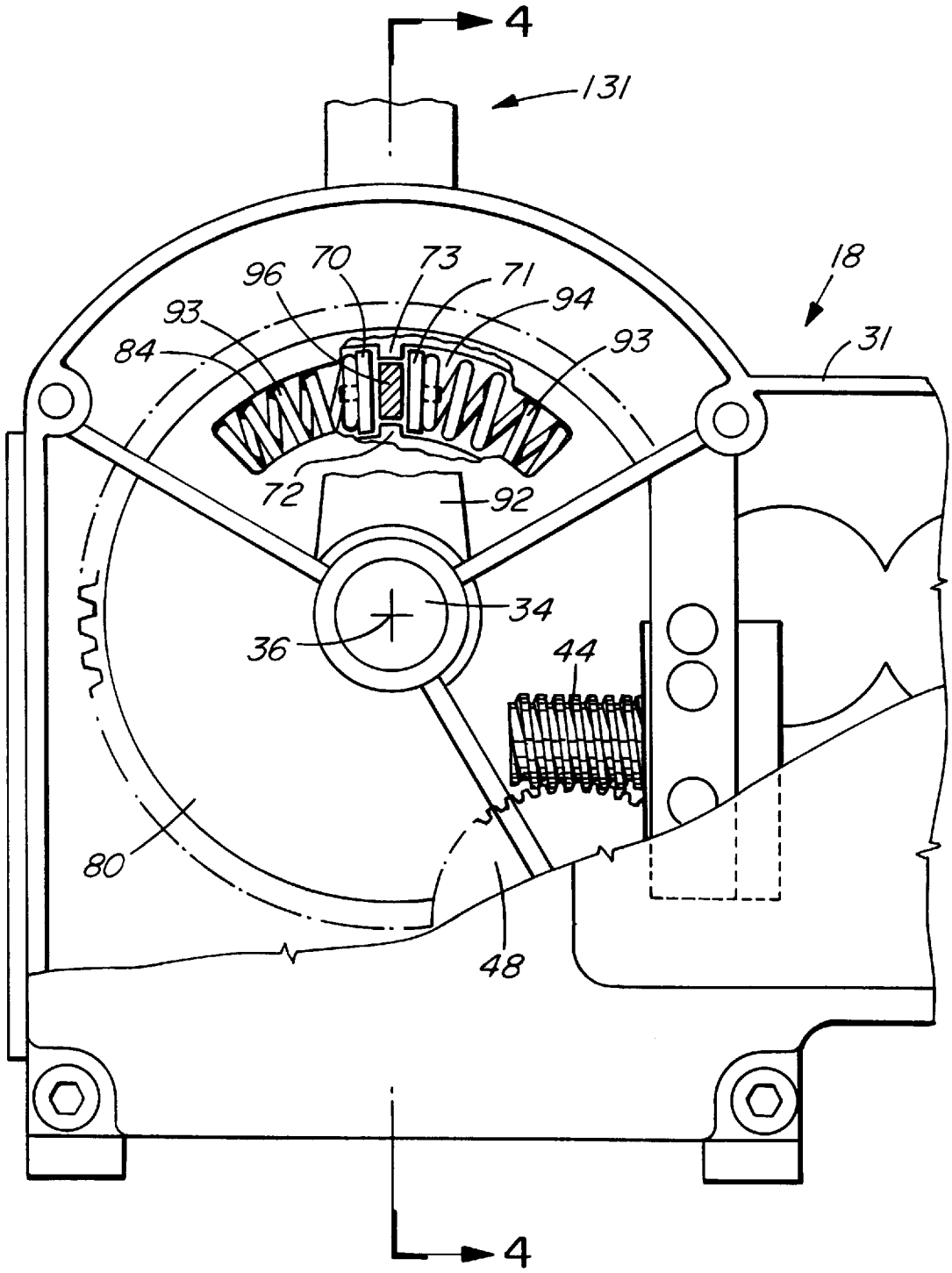
FIG. 3 is a simplified partially fragmented side elevation of the actuator of FIG. 2, some portions being removed to show internal detail.
Figure 4:
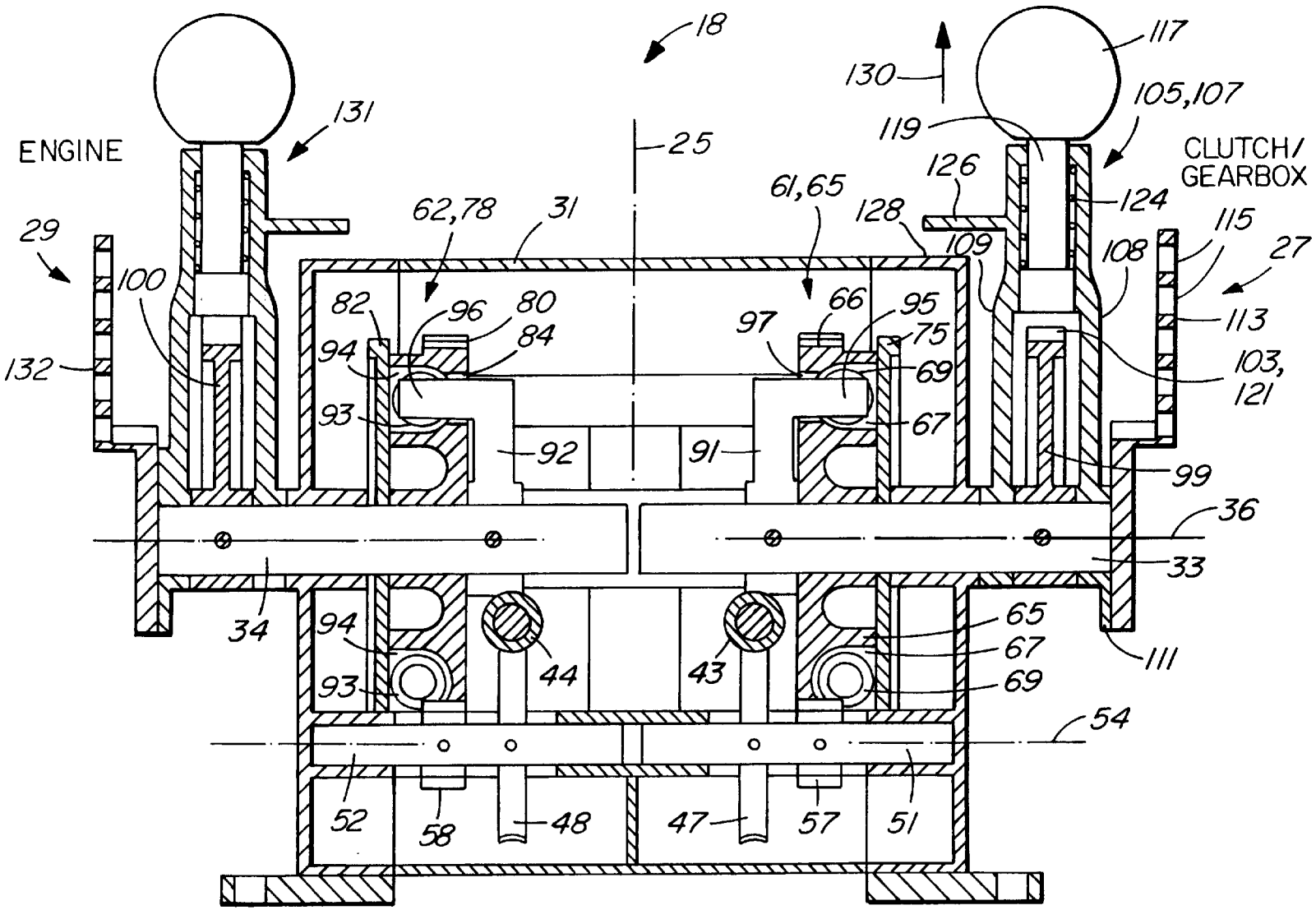
FIG. 4 is a simplified section taken generally on Line 4—4 of FIG. 3, some portions being omitted for clarity.

FIGS. 2 through 4

The actuator apparatus 18 is a first rotary embodiment according to the invention and is generally symmetrical about a main plane 25, as best seen in FIGS. 2 and 4, and has a clutch/gear box output 27 and engine output 29 located on opposite first and second sides of the main plane. Because function associated with each output is essentially identical, although responsive to different signals, and the portions are mirror images of each other, only one-half of the actuator apparatus 18 need be described. For clarity, in FIG. 2, portions of one-half of the actuator are omitted, to reveal detail not visible on the other half of the actuator.

The actuator apparatus 18 has a casing 31 providing support and bearings for first and second output shafts 33 and 34 respectively which are aligned for independent rotation about a common main axis 36. The actuator includes a first rotary input or power transducer, not shown, which receives an input signal from the processor 15 and has an output shaft carrying a first worm gear 43. A similar second rotary input or power transducer 42 has an output shaft driving a second worm gear 44, the gears 43 and 44 engaging corresponding first and second worm wheels 47 and 48 which are mounted on and rotate with first and second worm wheel shafts 51 and 52 respectively. The shafts 51 and 52 are journalled for independent rotation about a common worm wheel axis 54, and are connected to and rotate first and second pinions 57 and 58 respectively.

The apparatus further includes first and second rotary buffer assemblies 61 and 62 respectively which are mounted on the first and second output shafts 33 and 34 respectively. The buffer assembly 61 includes a first input member 65 which includes a first input gear wheel 66 having a toothed periphery which meshes with the first pinion 57 so as to rotate therewith. The gear wheel 66 has an arcuate groove 67 extending concentrically around the main axis 36, and carries a first coil spring 69 therein.

The first input member 65 further includes a first feedback gear wheel 75 secured to the gear wheel 66 with screws, not shown, for concurrent rotation with the gear wheel 66 as an integral unit. The feedback gear wheel 75 is spaced from the input gear wheel 66 to provide clearance for the spring 69 which is essentially completely enclosed and sandwiched between the input gear wheel and the feedback gear wheel. The gear wheels 66 and 75 have central openings which receive the output shaft 33 as a free fit thereon to permit relative rotation between the integral pair of gear wheels and the shaft.

The opposite second side of the plane 25 of the apparatus 18 further includes a second input member 78 having a second input gear wheel 80 and a second feedback gear wheel 82 secured together for mutual concurrent rotation on the shaft 34 in response to rotation of the second pinion 58, in a manner similar to the first input member. The gear wheel 80 has an arcuate slot 84 concentric with the axis 36 and extending over approximately 90 degrees of arc, i.e. 45 degrees either side of a mid-position. A second feedback potentiometer 86 has a potentiometer input pinion 88 meshed with the second feedback gear wheel 82 to rotate in response to movement of the gear wheel 82 and thus serves as second feedback signal transducer or generator. The first feedback gear wheel 75 similarly meshes with a pinion to drive a first feedback potentiometer or signal transducer, neither being shown, in a manner identical to the second potentiometer.

It can be seen that the feedback potentiometers are mounted at an output end of a respective reduction gear train which starts, for example, with the worm gear 44 and worm wheel 48, and drives through the shaft 52 and pinion 58 and input gear wheel 80, which is secured to the feedback gear wheel 82. This provides a gear train which, ignoring backlash between gear teeth, provides a positive connection between the input transducer 42 and the feedback signal transducer or potentiometer 86. Other locations of the feedback signal transducer are envisaged, provided the locations reflect position of the input member and thus are located "before" the resilient spring. For example, in an alternative, the feedback transducer could be located to be driven by the first worm wheel, although clearly this would result in a higher speed of revolution of the potentiometer than the illustrated location where it is driven off the slower rotating feedback gear wheel. Also, feedback transducers other than potentiometers could be used, for example rotary digital encoders and equivalents. It can be seen that feedback gear wheels 75 and 82 and associated feedback potentiometers or feedback signal transducers, provide a feedback apparatus to generate a feedback signal to be fed to the input controller 15. Clearly the feedback apparatus cooperates with the input member and the input controller to accurately locate the input member which contrasts with the normal function of a feedback apparatus, which is normally provided to accurately locate the item to be controlled, i.e. the fuel rack, etc.

The first and second output shafts 33 and 34 have inner ends to which are secured first and second output arms 91 and 92 extending radially from the respective shafts and carrying outwardly facing first and second tangs 95 and 96 respectively. The second tang passes through the arcuate slot 84 in the second input gear wheel 80, and the first tang 95 passes through a similar slot 97 (only partially shown in FIG. 2) in the first input gear wheel 66. Each slot has a pair of undesignated circumferentially spaced apart slot end walls which theoretically define limits of relative movement between the input and output members which is clearly approximately 90 degrees of arc as disclosed above.

As best seen in FIG. 3 and partially in FIG. 4, the second input gear wheel 80 has an arcuate groove 94 containing a second coil spring 93 which are generally similar to the groove 67 and spring 69 of the first input gear wheel 66. The coil spring 93 extends almost completely around the groove 94 and has closely located spring ends carrying spring end caps 70 and 71 held captive thereon. The groove 94 has radially spaced apart inner and outer spring stops 72 and 73 which extend inwardly into the groove and engage the spring end caps 70 and 71 to locate ends of the spring 93 securely against spring forces. Length of the groove 94 between the stops 72 and 73 is less than uncompressed length of the spring 93 and the end caps, and thus the spring is pre-loaded within the groove. The amount of pre-load of the spring can be considerable, for example anywhere between about 10 and 30 per cent of the length of the spring, and thus any relatively small deflection of the spring in addition to the pre-load deflection, for example up to about one quarter of an inch, produces a negligible increase in force from the spring.

The spring stops have radially aligned lug faces which are spaced circumferentially apart at a critical distance to provide an accurately dimensioned space between opposite end faces of the end caps. The tang has a width, as measured circumferentially, which is a snug fit in the space between the spring end caps 70 and 71 so as to essentially eliminate any lost motion that might otherwise occur between the tang and the end caps. Thus, the spring end caps 70 and 71 of the spring 93 essentially engage opposite faces of the tang 96 so as to resiliently centre the tang. In this way, the tang experiences force from the spring immediately after relative movement to displace the tang from its centred position between the end caps. Other means of essentially eliminating lost motion between the tang and ends of the spring can be devised. The first spring 69 is similarly retained within the arcuate groove 67 and cooperates with the first tang 95 in a similar manner.

The said pre-loading of the spring locates the respective tang firmly yet resiliently within the respective arcuate slot. It is seen that on both sides of the apparatus 18 portions of the arcuate grooves are accessed through the adjacent arcuate slots. The output arms 91 and 92 and thus the tangs 95 and 96 are mounted securely on the respective output shafts 33 and 34 to rotate therewith. The arms, tangs and respective output shafts comprise respective output members which cooperate through the respective coil springs with the input member to rotate in response to rotation of the respective input member by an amount as modified by resilience in the spring, as will be described. The pre-load from the spring is such that in most circumstances force from the spring on the respective tang locates the tang generally centered within the groove or a few degrees displaced therefrom, and only in exceptional circumstances, e.g. obstructing movement due to a foreign object, would the tang contact the end walls of the arcuate slots.

Thus, in summary, the input gear wheels 66 and 80 serve as input members which are adapted to move in response to the input signal outputted from the input controller. The arms 91 and 92, the associated tangs 95 and 96, and the output shafts 33 and 34 serve as output members which are at least partially responsive to movement of the input members and as will be described cooperate with the items to be controlled. Each spring serves as a resilient member cooperating with the input and output members to provide a resilient buffer between application of the input signal to the input member and corresponding movement of the output member.

The output members further comprise first and second output sectors 99 and 100 which are secured to the first and second output shafts 33 and 34 respectively to rotate therewith. The sector 99, relating to the clutch/gear box, has an arcuate periphery 101 generally concentric with the output shaft 33 and provided with a recess serving as an indexing portion 103. The arcuate periphery 101 extends 90 degrees on either side of the indexing portion which thus is located at a mid-position representing neutral. The periphery 101 has steeply inclined lead-in portions 102 located symmetrically at each end of the periphery and extending inwardly for reasons to be described. A first manual override lever 105 has a bifurcated lever body 107 having a pair of legs 108 and 109 which straddle the sector 99 and have inner ends provided with aligned bores which are journalled for rotation on the output shaft 33. The leg 108 has an output mounting 111 provided with four radial arms which correspond to four radial arms provided on a first output lever 113 of the clutch/gear box output 27 and is secured thereto with bolts, not shown. The output lever 113 has a plurality of openings 115 at different distances from the axis 36 which receive an output coupling, not shown, which can be a rigid strut or push-pull cable which extends directly to an input of a clutch/gear box, not shown.

The manual override lever 105 includes a knob 117 for gripping by an operator in the engine room for direct or local control, the knob being mounted on a radially aligned shaft 119 extending from a bore of the lever body 107. The shaft 119 has an inner end 121 which serves as a detent to engage the indexing portion 103 which is a complementary recess in the periphery of the first output sector 99. The shaft 119 is urged resiliently inwardly by an enclosed override coil spring 124, so that normally the detent engages the indexing portion so that the manual lever rotates in response to rotation of the output shaft and output sector. The lever body 107 has a scale pointer 126 extending inwardly therefrom and adapted to sweep an arcuate visual indicator scale 128 provided on the casing 31, and mounted to be concentric with the main axis. Thus, the scale pointer sweeps the scale as the lever 105 rotates to provide a visual indication of the output signal.

In normal operation when the override lever is engaged with the output sector 99, it is not possible to rotate the lever because the output shaft is restricted against movement due to the gear ratio of the apparatus. However, should the system fail, the knob 117 can be pulled upwardly per an arrow 130 so as to disengage the inner end 121 from the indexing portion 103 and thus from the gear train, so as to permit rotation of the lever independently of the output shaft when required. When the inner end 121 has disengaged the portion 103 or recess in the periphery, the inner end is still urged against the periphery 101 so as to automatically re-engage the recess if the sector is rotated remotely from a control head when the remote control is to re-established, as will be described. Thus, in normal use, the manual override lever is engaged with the output shaft to rotate therewith when engaged, and can rotate freely thereon when disengaged therefrom. Clearly, the override lever cooperates with the output lever 113 arm which in turn cooperates with the item to be controlled.

On the opposite side of the main plane 25, the second output sector 100 cooperates with a second manual override lever 131, which in turn cooperates with the corresponding second output lever 132 which cooperates with the engine output 29 and a coupling associated therewith. The output sector 100 also has a recessed indexing portion defining half throttle, and idle and full throttle are spaced 45 degrees at opposite sides of the indexing portion. Other structure associated with the engine output 29 is generally similar to that on the first side of the apparatus and is not described in detail.

Clearly, the manual override levers and associated structure are not necessary for normal operation of the apparatus, but are provided for emergency use or for direct control from the engine room for servicing or local control, as well as providing a visual indication of the signal outputted to the clutch/gear box output 27 or engine control means. Clearly, without the manual override lever, the output lever 113 would be rigidly attached to the output shaft 33 by other means and output a signal directly to the clutch/gear box.

OPERATION

Most of the initial set-up of the apparatus is performed in a usual manner, requiring a technician with a microprocessor to adjust datum positions and ranges of movement. The technician selects the appropriate opening in the output lever 113 to provide a sufficient stroke to actuate the clutch/gear box based on length of the mechanical coupling, etc. Similarly, the appropriate datum positions, ranges and opening on the second output lever 132 are selected for coupling to the speed control of the engine.

The system is initially set-up ignoring the resilient buffer, so that a zero setting on the controller or processor 15 results in a zero setting at the output of the apparatus actuator apparatus 18. Thus, neutral, forward and reverse, and idle and full throttle settings on the controller 15 result in similar corresponding settings at the actuator apparatus 18. To provide sufficient over-stroking of the actuator for the purposes of the invention, it is necessary to re-adjust conventional trim potentiometers, electronic datum and/or range settings, or equivalent structure normally provided in the controller 15 to provide a relatively small additional movement of the input gear wheels so as to slightly compress the springs 69 and 93 in addition to the said pre-loading of the springs. This additional movement applies additional force to the linkage between the output arm and the item being controlled, that is for the arm 113 the clutch/gear box 27, or for the output lever 132 and the engine speed control 29. The slight additional compression of the springs is not critical provided it generates sufficient additional movement to absorb any lost motion or wear in the linkages and ensure that the item being controlled fully engages normal stops or indents provided at extreme ends of the range of motion.

For example, the additional movement ensures that the item being controlled fully engages forward and reverse gears, or positive attainment of maximum engine speed and idle at opposite ends of the engine speed range. Clearly, in view of the number of variables involved, it is impossible to state precisely the additional movement necessary to attain the full range of movement for the item to be controlled, but it is likely to be between about 0.025 and 0.25 inches (0.64 and 6.4 millimetres) which represents a very small increase in the degree of compression of the spring with a corresponding very small increase in force The initial overstroking adjustment removes any residual lost motion that might exist between the output arm and the item being controlled. The final overstroking adjustment provides a slight additional pre-compression of the spring so as to increase load slightly on the item being controlled so as to urge the item being controlled more firmly against the normal stops which define limits of movement of the item to be controlled. Clearly, if exceptional wear is anticipated, (i.e. in an exceptionally long cable run or multiple linkages), the degree of over-stroking would be increased somewhat over a situation where minimal or normal wear is anticipated.

As indicated earlier, because the spring is relatively highly pre-compressed, any additional force generated by the slight additional movement of the spring is relatively small and does not increase force for moving the item to be controlled. Maximum compression of the spring generates an output force less than maximum output force from the output shaft if used without the spring, thus ensuring a resilient buffer which, in general, has less force than the normal output without a resilient buffer.

It can be seen that the spring serves as a resilient member cooperating the input and output members to provide a resilient resistance to relative rotation between the members in opposite directions, that is in a first direction, for example to attain forward gear (or full speed), and in an opposite second direction to attain reverse gear (or idle). The invention does not effect in any manner how the operator uses the controls and is only noticeable in the fact that maintenance periods between adjustment of the controls are extended considerably, or there is a reduction in damage should an object inadvertently obstruct movement of the item being controlled.

Referring to FIG. 1, an output signal generated by one of the manual control heads 13 is fed to the electronic processor 15 which processes the signal which is then fed as an input signal to the actuator apparatus 18. Assuming the signal is full throttle in a forward direction, to attain forward, the first rotary input transducer drives through the worm gear 43 and the worm wheel 47 to rotate the shaft 51, which in turn through the pinion 57 and input gear wheel 66 rotates the first buffer assembly 61. This in turn rotates the output shaft 33, which rotates the output lever 113 to shift the clutch/gear box from neutral into forward. Any wear in the linkage between the output lever 113 and the clutch/gear box would be accommodated by overstroking of the buffer assembly 61 and resilience therein, thus ensuring that forward gear is fully engaged without any undue force.

To control engine speed, the second rotary input transducer, not shown, receives a signal from the processor 15 to rotate the second worm gear 44, the second worm wheel 48 and thus the shaft 52. Rotation of the shaft 52 is transferred to the second pinion 58 and input gear wheel 80, which results in the second buffer assembly 62 rotating so as to move the second output lever 132 from idle to full throttle. Resilient buffering in the assembly 62 ensures that there is sufficient movement and force from the output lever 132 for the linkage extending to the fuel rack to fully engage full throttle.

Figure 5:
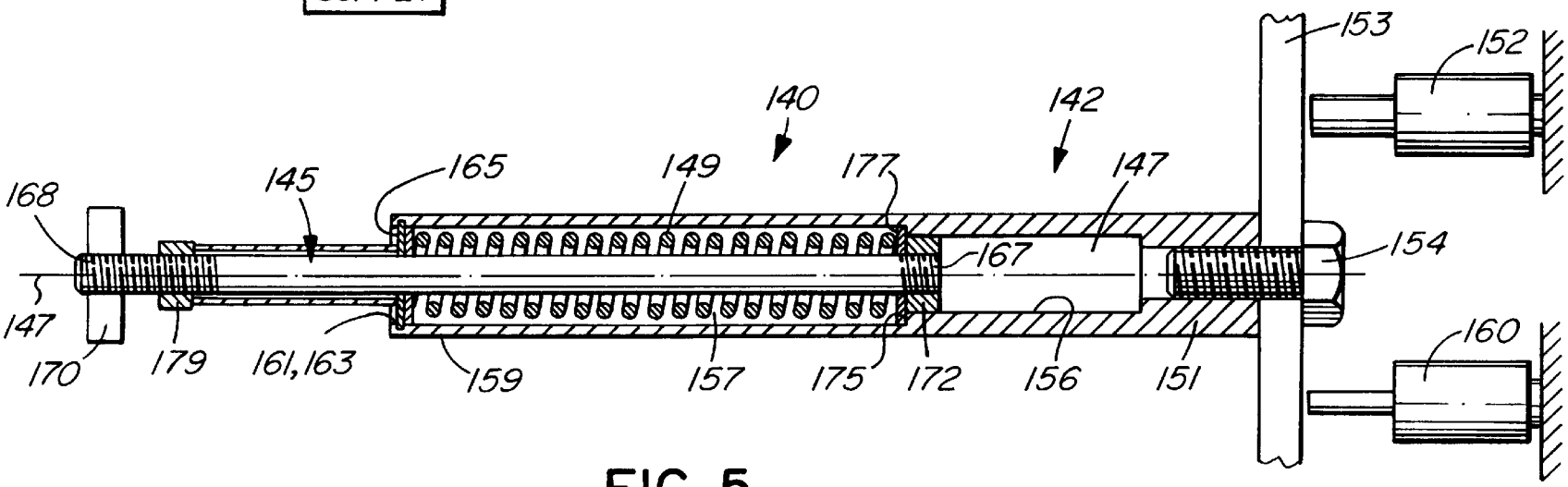
FIG. 5 is a simplified fragmented longitudinal section of an alternative "buffered" linear actuator according to the invention, shown fitted with a linear resilient buffer.

Thus, it can be seen that the method of controlling the item according to the invention comprises outputting from an input controller an electrical signal generated from a demand signal applied manually at a control head 13, the demand signal being received by the input controller 15. The signal outputted by the controller is transduced and transmitted as physical movement to the input member 65, 78 that is the input gear wheel 66, 80. The method further comprises applying the physical movement to a resilient member, namely the spring 69, 93 and transferring through the resilient member at least a portion of the physical movement to the output member, that is the tang 95, 96 and output shaft 33, 34. Simultaneously, a feedback signal is generated reflecting movement of the input member, and the feedback signal is transmitted to the input controller to accurately locate the input member. In the particular example shown, the input signal is transmitted by rotation of the input member 65, 78 about the main axis 36 and at least a portion of rotation of the input member is transferred to the output member which also rotates about the same main axis. Other means of mounting the input member and the output member for relative movement therebetween are disclosed in FIG. 5, which shows an alternative linear structure.

Clearly, for positions intermediate of any positive stop, such as between idle and full throttle, because there are no stops the buffer assembly is effectively inactive, i.e. there is no relative movement between input and output members. Thus, a demand signal from the control head to the processor results in the appropriate fuel rack position being attained without relative movement within the buffer assembly.

Should there by a failure in the system, or if an operator in the engine room wishes to control the engine and/or gear box directly, i.e. locally, the override lever 105, 131 is pulled upwardly, so as to disengage the respective indexing portion or recess 103 in the sector periphery, and thus from the respective output shaft 33, 34. This disengagement permits movement of the override lever 105, 131, to be transferred directly to the output lever 113, 132 and thus the clutch/gear box, without rotating the output shaft 33, 34 respectively. Clearly, if disengagement were not possible, it would be essentially impossible to rotate the lever due to reverse driving of the high gear ratio due to the worm drive and associated pinions and gear wheels.

Force from override spring within the override lever forces the detent against the periphery, and when it is desired to restore remote control for the clutch/gear box and/or engine without the engine running, the operator in the wheel house, or at a remote control head, initiates an idle to full ahead to full astern signal which is transferred to the output shafts 33 and 34. This signal results in full 180 degree rotations of the sectors 99 and 100 which catches or picks-up the detents of the manual override levers 105 and 131, so as to re-engage each manual override lever with the respective output shaft. This enables an operator at the bridge to reconnect the output shaft 33 to the output lever 113 to resume normal remote control of the clutch/gear box without a separate manual intervention in the engine room. The engine speed control can be similarly re-engaged remotely from the control head. This full range of movement of each output member is necessary to re-engage the manual override lever irrespective of its location. The lead-in portions 102 of the output sectors facilitate re-engagement of the detent with the periphery of the output member.

ALTERNATIVES

In the apparatus 18 the input member 65, 78 has the arcuate slot therein and the output member has the tang 95, 96. Clearly, the structure of the input and output members can be reversed and other structures can be devised to provide the resilient buffer between the input and output member. In general, one of the members of the resilient buffer has an arcuate slot therein, and the remaining member of the resilient buffer has a tang located adjacent the arcuate slot. The resilient member is located to be accessible through the slot and cooperates with the tang when the tang extends through the slot. Also, while the input and output members of the resilient buffer are shown mounted for rotation about the common main axis 36, in an alternative, not shown, the axes of the input and output members could be separated but preferably are parallel to each other.

FIG. 5

An alternative buffered linear actuator 140 is adapted for use with apparatus where linear input and output is preferred to rotary input and output of the actuator apparatus 18 of FIGS. 2–4. The actuator 140 has a generally hollow cylindrical main body 142 and a rod 145 movable axially thereto with respect to a main longitudinal axis 147. In this particular instance, the body 142 serves as an input member, and the rod 145 serves as an output member, although these functions can be interchanged. The apparatus further includes a compression coil spring 149 enclosing a portion of the rod 145 and cooperating with the body and the rod in a manner to be described, the spring being functionally similar to the coil springs 69 and 93 of the rotary actuator of FIGS. 2 through 4.

The main body 142 has an input end portion 151 secured to an input strut 153 which is moved by an input transducer 152. The input transducer 152, such a linear actuator, cooperates with the input strut 153 so as to move the strut in direction of an arrow 155, an opposite end of the transducer being secured to a fixed portion of the apparatus. The input end portion has an internally threaded bore which receives a bolt 154 to secure the end portion 151 to the input strut. The body also has a clearance chamber 156 and a spring chamber 157, the spring chamber housing the spring 149. The spring chamber is generally adjacent an output end portion 159 of the body 142, and the clearance chamber 156 is disposed between the input end portion and the spring chamber, both chambers being aligned along the axis 147.

A feedback signal transducer 160 is connected to the input strut 153 of the and to a fixed portion of the apparatus to detect movement of the main body or input member 142 and to generate a feedback signal which is fed back to the controller. Thus, the transducer 160 is a portion of the feedback apparatus to generate a feedback signal which is fed back to the input controller 15, FIG. 1, and processed as before. The transducer 160 cooperates with the input member, namely the main body 142, and the input controller to accurately locate the input member. Clearly, the transducer 160 could be located in any position which moves with the body 142 to reflect movement and position thereof.

The output end portion 159 has an annular groove 161 extending around an inner wall of the spring chamber and receiving a spring retainer clip 163, such as a "Circlip" (TM) which is securely located within the groove. A washer 165 is located within the spring chamber 157 by the retainer clip 163 and has a bore which is a close sliding fit on the rod 145. The spring 149 urges the washer 165 against the clip 163.

The rod 145 has a rod inner end 167 located within the clearance chamber 156, and a rod outer end 168 cooperating with an output strut 170, which in turn cooperates with structure associated with a gear box/clutch or speed control of an engine. The rod inner end 167 has a stop member 172 secured thereto, the member being a free sliding fit within the clearance chamber 156. The chamber 156 and chamber 157 are separated by an annular shoulder 175 and an intermediate washer 177 is fitted within the spring chamber between the shoulder and spring and is urged against the shoulder 175 by the spring 149. Thus, the spring 149 has an inner end adjacent the washer 177, and an outer end adjacent the washer 165. The spacing between inwardly facing faces of the washers 165 and 177 is less than relaxed length of the spring 149 so that the spring is effectively pre-loaded between the washers, in a manner somewhat similar to the springs 69 and 93 of FIGS. 1 through 4. A nut 179 is received on complementary threads of the outer end 168 of the rod, and a loose fitting sleeve 181 is interposed between the nut 179 and the washer 165 the opening in the washer being smaller than the sleeve 181. The nut 179 can be tightened lightly on the rod 145 so as to urge the sleeve 181 against the washer 165, so as to take-up any lost motion that might exist between the rod 145 and the body. Further tightening of the nut 179 increases pre-loading on the spring 149 which can be finely adjusted providing a desired amount of pre-load.

Thus, it can be seen that the input and output members, namely the body 142 and the rod 145 cooperate telescopically for axial movement along the common main longitudinal axis 147, although clearly in an alternative, not shown, the axes could be separate but parallel to each other.

In operation, an input signal from the control head is outputted from the controller and fed to the input transducer 152 which applies a force per the arrow 155 to the input strut 153 which in turn applies a compressive force to the body 142. The rod 145 moves similarly until a resistance is encountered, for example at a full throttle speed setting of the fuel rack, at which time the sleeve 181 applies a force to the right on the washer 165, which would in turn compresses the spring 149, causing the stop member 172 to move a small distance into the chamber 156. This ensures a resilient force and additional movement is applied to the fuel rack so as to ensure that the fuel rack attains full speed setting. Alternatively, if force on the input member was in an opposite direction to the arrow 155, the rod 145 would be subjected to tension and the intermediate washer 177 would be lifted off the shoulder 175 by the stop member 172 as the spring was compressed. The spring or resilient member cooperates with the input and output members to provide a resilient buffer or a resilient resistance to both extension and retraction of the members along the longitudinal axis. Thus, the input signal is transmitted by longitudinal movement of the input member along the axis, and at least a portion of the movement of the input member is transferred to the output member which also moves longitudinally along the longitudinal axis.

I claim:

1. A control apparatus for controlling movement of an item, the apparatus comprising:

an electrical input transducer having an input and an output, the input being adapted to receive an electrical input signal derived from a demand signal of an operator, which signal results in a physical movement of the output of the input transducer, (b) an input member responsive to the physical movement of the output of the input transducer, so that the movement of the input transducer serves as a mechanical input signal to the input member, (c) an output member being connectible to the item to be controlled to move the item, (d) a resilient member interconnecting the input member and the output member to provide a resilient buffer between application of the mechanical input signal to the input member and corresponding movement of the output member so that the output member is at least partially responsive to said movement of the input member, and (e) a feedback apparatus to generate a feedback signal to be fed to the input transducer, the feedback apparatus reflecting movement of the input member and providing communication between the input member and the input transducer to accurately locate the input member.

2. An apparatus as claimed in claim 1, in which:

(a) the resilient member is pre-loaded to generate a force on the output member which is sufficient to control said item but is less than a force applied by the input member, so as to reduce chances of damaging the apparatus.

3. An apparatus as claimed in claim 1, in which:

(a) the resilient member is located between the input and output members of the resilient buffer to generate a resilient force against relative movement between the members in a first direction, and also, in an opposite second direction.

4. An apparatus as claimed in claim 1, in which:

(a) the input and output members of the resilient buffer are mounted for rotation about a common main axis.

5. An apparatus as claimed in claim 4, in which:

(a) the resilient member is located between the input and output members to provide a resilient resistance to relative rotation between the members in opposite directions.

6. An apparatus as claimed in claim 4, in which:

(a) one of the members of the resilient buffer has an arcuate slot therein, the slot being concentric with the main axis, (b) the remaining one of the members of the resilient buffer has a tang located adjacent the arcuate slot, and (c) the resilient member is located to be accessible through the slot and to cooperate with the tang.

7. An apparatus as claimed in claim 6, in which:

(a) the tang extends through the slot, (b) the slot has a pair of circumferentially spaced apart slot end walls which define limits of relative movement between the input and output members, and (c) a compression coil spring is fitted adjacent the slot and adjacent the tang to resiliently centre the tang.

8. An apparatus as claimed in claim 5, in which:

(a) the output member comprises the tang and an output shaft mounted for rotation about a main axis, the tang being mounted securely on the output shaft to rotate therewith, and (b) the input member has the arcuate slot therein, and is mounted on, and journalled for rotation relative to, the output shaft.

9. An apparatus as claimed in claim 8, further including:

(a) a manual override lever for actuation by an operator as required, the manual override lever being releasably engageable with the output shaft to rotate therewith when engaged, and to rotate freely thereon when disengaged, the override lever being connected to an output lever which in turn moves the item to be controlled.

10. An apparatus as claimed in claim 9, further comprising:

(a) a visual indicator scale mounted to be concentric with the main axis, and (b) a scale pointer mounted on the manual override lever and positioned to sweep the scale as the lever rotates to provide a visual indication of the output signal.

11. An apparatus as claimed in claim 9, further comprising:

(a) an output sector mounted on the output shaft, the output sector having an arcuate periphery generally concentric with the output shaft and provided with an indexing portion, and (b) the manual override lever having a detent which normally engages the indexing portion to connect the manually override lever to the output shaft to rotate therewith, but can be disengaged from the indexing portion to permit rotation of the lever independently of the output shaft when required.

12. An apparatus as claimed in claim 11, in which:

(a) the detent is spring-urged against the arcuate periphery of the output sector to automatically engage the indexing portion when aligned therewith.

13. An apparatus as claimed in claim 1, in which:

(a) the input and output members of the resilient buffer are mounted for longitudinal axial movement.

14. An apparatus as claimed in claim 13, in which:

(a) the input and output members are mounted telescopically for axial movement therebetween along a common longitudinal axis.

15. An apparatus as claimed in claim 14, in which:

(a) the resilient member is located between the input and output members to provide a resilient resistance to both extension and retraction of the members along the longitudinal axis.

16. A method of controlling movement of an item, the method comprising the steps of:

(a) receiving at an electrical input transducer an electrical input signal derived from a demand signal of an operator, (b) transducing the electrical input signal to generate a physical movement of an input member, (c) applying the physical movement to a resilient member, and transferring through the resilient member at least a portion of the physical movement to an output member, the output member being connectable to the item to be controlled, and (d) generating a feedback signal reflecting movement of the input member, and transmitting the feedback signal to the input transducer to accurately locate the input member.

17. A method as claimed in claim 16, further characterised by:

(a) pre-loading the resilient member to augment resistance to movement thereof so that the resilient means generates a force on the output member which is sufficient to control the said item but is less than force applied to the input means to avoid damage to the output means.

18. A method as claimed in claim 16, further characterised by:

(a) generating a resilient force between the input and output members against relative movement between the members in a first direction, and also in an opposite second direction.

19. A method as claimed in claim 16, further characterised by:

(a) resiliently centering the output member with respect to the input member so that a resilient resistance to relative rotation between the members in opposite directions is generated when one member is displaced relative to the remaining member.

20. A method as claimed in claim 16, further characterised by:

(a) transmitting the input signal by rotation of the input member about a main axis, and (b) transferring at least a portion of the rotation of the input member to the output member, which also rotates about the main axis.

21. A method as claimed in claim 16, further characterised by:

(a) manually disengaging a manual lever from normal engagement with the output member to permit independent manual movement of the item to be controlled, without corresponding movement of the output member and other structure cooperating therewith, and (b) automatically re-engaging the manual lever with the output member by remotely moving the output member through a full range of movement to automatically pick up the manual lever at some point of that range of movement.

22. A method as claimed in claim 16, further characterised by:

(a) transmitting the input signal by longitudinal movement of the input member along an axis, and (b) transferring at least a portion of the movement of the input member to the output member, which also moves longitudinally about a longitudinal axis.

* * * * *